US008142524B2

(12) United States Patent
Roby et al.

(10) Patent No.: US 8,142,524 B2
(45) Date of Patent: Mar. 27, 2012

(54) BIODIESEL-DERIVED COMBUSTION IMPROVER

(75) Inventors: Stephen H. Roby, Hercules, CA (US); Guangci Zhou, El Cerrito, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 685 days.

(21) Appl. No.: 12/241,411

(22) Filed: Sep. 30, 2008

(65) Prior Publication Data

US 2010/0077651 A1 Apr. 1, 2010

(51) Int. Cl.
*C10L 1/18* (2006.01)

(52) U.S. Cl. ..... 44/307; 44/308; 44/388; 44/389

(58) Field of Classification Search ..... 44/301, 44/307, 308, 388, 389; 525/285
See application file for complete search history.

(56) References Cited

U.S. PATENT DOCUMENTS

| | | | | |
|---|---|---|---|---|
| 4,859,312 | A | 8/1989 | Miller | |
| 4,954,572 | A * | 9/1990 | Emert et al. | 525/285 |
| 5,158,665 | A | 10/1992 | Miller | |
| 5,288,619 | A | 2/1994 | Brown et al. | |
| 5,300,210 | A | 4/1994 | Zones et al. | |
| 6,204,426 | B1 | 3/2001 | Miller et al. | |
| 6,630,066 | B2 | 10/2003 | Cash et al. | |
| 6,723,889 | B2 | 4/2004 | Miller et al. | |
| 6,841,063 | B2 | 1/2005 | Elomari | |
| 2010/0037513 | A1 * | 2/2010 | Petrucci et al. | 44/301 |

FOREIGN PATENT DOCUMENTS

| | | |
|---|---|---|
| JP | 2007322251 | 12/2007 |
| KR | 100734201 | 7/2007 |
| KR | 100734202 | 7/2007 |

OTHER PUBLICATIONS

U.S. Appl. No. 12/181,652, filed Jul. 29, 2008, Miller
R. Baum, "Microalgae are Possible Source of Biodiesel Fuel," Chem. & Eng. News, vol. 72(14), pp. 28-29, 1994.
Huber et al., "Synthesis of Transportation Fuels from Biomass: Chemistry, Catalysts, and Engineering," Chem. Rev., vol. 106, pp. 4044-4098, 2006.
Meher et al., "Technical aspects of biodiesel production by transesterification—a review," Renewable & Sustainable Energy Reviews, vol. 10, pp. 248-268, 2006.
Pearce, "Fuels Gold," New Scientist, Sep. 23, pp. 36-41, 2006.
Rana et al., "A Review of Recent Advances on Process Technologies for Upgrading of Heavy Oils and Residua," Fuel, vol. 86, pp. 1216-1231 (2007).
PTO ISR dated May 10, 2010; PCT International Application No. PCT/US2009/058741.

* cited by examiner

*Primary Examiner* — James Goloboy
*Assistant Examiner* — Chantel Graham
(74) *Attorney, Agent, or Firm* — Edward T. Mickelson

(57) ABSTRACT

The present invention is generally directed to novel fuel compositions and to methods (i.e., processes) for enhancing the combustion efficiency and/or other properties of diesel fuels, particularly wherein such diesel fuels are, or comprise, biodiesel, such biodiesel typically having poorer low-temperature properties than traditional (petroleum) diesel. Generally, such fuel compositions are provided by the creation and inclusion of a quantity of one or more epoxy-ester species, such species serving as combustion improvers for the fuel composition of which they are part.

22 Claims, 5 Drawing Sheets

(2)

(3)

(4)

(5)

BIODIESEL-DERIVED COMBUSTION IMPROVER

FIELD OF THE INVENTION

This invention relates generally to fuel compositions, and particularly to fuel compositions comprising epoxy-ester species derived from biodiesel, wherein such epoxy-ester species serve to enhance combustion of, and yield a higher cetane value for, the fuel composition of which they are a component.

BACKGROUND

Biofuels are of increasing interest for a number of reasons including: (1) they are a renewable resource, (2) their production is less dependent on geopolitical considerations, (3) they provide the possibility of a direct replacement of petroleum-based fuels in existing vehicles, and (4) the net greenhouse gas emissions can be substantially reduced by virtue of $CO_2$ uptake by biofuel precursors—particularly in the case of cellulosic feedstocks. See Pearce, "Fuels Gold," New Scientist, 23 September, pp. 36-41, 2006.

An easily-obtainable biofuel is vegetable oil, which largely comprises triglycerides and some free fatty acids. The properties of vegetable oil, however, make it generally inappropriate for use as a direct replacement for petroleum diesel in vehicle engines, as the vegetable oils' viscosities are generally too high and do not burn cleanly enough, thereby leaving damaging carbon deposits on the engine. Additionally, vegetable oils tend to gel at lower temperatures, thereby hindering their use in colder climates. These problems are mitigated when the vegetable oils are blended with petroleum fuels, but still remain an impediment for long-term use in diesel engines. See Pearce, 2006; Huber et al., "Synthesis of Transportation Fuels from Biomass: Chemistry, Catalysts, and Engineering," Chem. Rev., vol. 106, pp. 4044-4098, 2006.

Transesterification is currently a method used to convert vegetable oils into diesel-compatible fuels (i.e., biodiesel) that can be burned in conventional diesel engines. When methanol is used to transesterify vegetable oil, the resulting biodiesel is primarily composed of methyl esters that have long straight chain aliphatic groups attached to a carbonyl group (i.e., fatty acid methyl esters, or FAME). Such biodiesel invariably comprises ester species having regions of unsaturation, i.e., double bonds, although the amount of such unsaturated ester species can vary widely depending upon its biomass source. See, e.g., Meher et al., "Technical aspects of biodiesel production by transesterification—a review," Renewable & Sustainable Energy Reviews, vol. 10, pp. 248-268, 2006.

In addition to methods for improving the quality of biofuels, methods for using biofuels and/or their analogues and/or derivatives for improving the quality diesel fuel, in general, would be a welcome contribution. An example of such an improvement would be an elevation of a diesel fuel's cetane rating (or number).

Accordingly, methods for enhancing the cetane rating and/or other properties of diesel fuels, and the compositions resulting therefrom, would be highly beneficial—particularly wherein such methods and compositions take advantage of the benefits of both biodiesel and petroleum diesel fuels and/or fuel precursors and/or fuel derivatives.

BRIEF DESCRIPTION OF THE INVENTION

The present invention is generally directed to novel fuel compositions and to methods (i.e., processes) for enhancing the combustion efficiency of diesel fuels, particularly wherein such diesel fuels are (or comprise) biodiesel.

In some embodiments, the present invention is directed to one or more diesel fuel compositions, such diesel fuel compositions comprising (a) a fuel component and (b) an additive component comprising a quantity of one or more epoxy-ester species having a general formula:

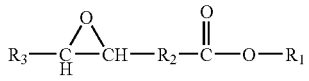

where $R_1$ is selected from the group consisting of C1 to C3 alkyl moieties, $R_3$ is selected from the group consisting of C1 to C10 alkyl moieties and C1 to C10 alkenyl moieties, and $R_2$ is a molecular linkage comprising subunits and expressed as:

$$—S_5—S_4—S_3—S_2—S_1—$$

where subunits $S_1$, $S_3$, and $S_5$ are independently selected from the group consisting of C1 to C6 alkyl moieties, C1 to C6 alkenyl moieties, C1 to C6 alkoxy moieties, the absence of any such subunit, and combinations thereof; and where subunits $S_2$ and $S_4$ are independently selected from the group consisting of epoxy moieties, C1 to C4 alkyl moieties, C1 to C4 alkenyl moieties, C1 to C4 alkoxy moieties, the absence of any such subunit, and combinations thereof; and wherein said one or more epoxy-ester species account for between 0.1 and 60 percent of the diesel fuel composition by weight.

In some embodiments, the present invention is directed to one or more methods of a first type for improving combustion efficiency, and correspondingly cetane rating, in a diesel fuel, such method(s) comprising the steps of: (a) generating a quantity of epoxy-ester species, said generating comprising the sub-steps of (i) esterifying a quantity of unsaturated fatty acids having a carbon number of from 8 to 22 with a quantity of alcohol so as to form a quantity of unsaturated esters; and (ii) epoxidizing the unsaturated esters to form a quantity of epoxy-ester species; and (b) combining the quantity of epoxy-ester species with a quantity of diesel fuel to provide a diesel fuel composition with increased combustion efficiency.

In some embodiments, the present invention is directed to one or more methods of a second type for improving combustion efficiency, and correspondingly cetane rating, in a diesel fuel, such method(s) comprising the steps of: (a) generating a quantity of epoxy-ester species, said generating comprising the sub-steps of: (i) extracting a quantity of unsaturated esters from an ester-based biodiesel; and (ii) epoxidizing the unsaturated esters to form a quantity of epoxy-ester species; and (b) combining the quantity of epoxy-ester species with a quantity of diesel fuel to provide a diesel fuel composition with increased combustion efficiency.

In some embodiments, the present invention is directed to one or more methods of a third type, such methods comprising the steps of: (a) providing a quantity of biodiesel fuel comprising a quantity of unsaturated ester species; (b) epoxidizing at least a portion of the unsaturated ester species in the biodiesel fuel to form a biodiesel fuel composition comprising a quantity of epoxy-ester species, wherein said biodiesel fuel composition has enhanced combustion efficiency relative to the biodiesel fuel from which it was derived.

In some embodiments, the present invention is directed to one or more methods of a fourth type, such methods comprising the steps of: (a) providing a quantity of triglyceride-based oil comprising triglyceride species bearing regions of unsaturation; (b) transesterifying the triglyceride-bearing oil to yield an esterified composition comprising unsaturated esters; (c) epoxidizing the esterified composition to yield an epoxidized composition comprising epoxy-ester species; and (d) blending at least a portion of the epoxidized composition with diesel fuel to form an enhanced diesel fuel composition.

Generally, the present invention is directed to methods for improving the quality of biodiesel by decreasing the content of unsaturated species contained therein, and for generally improving the combustion efficiency in diesel fuels (biodiesel, conventional diesel, and combinations thereof) via the addition and/or in situ generation of epoxy-ester species in said fuel. The present invention is also directed to novel fuel compositions provided by such methods, wherein such compositions generally comprise (a) a fuel component and (b) an additive component.

The foregoing has outlined rather broadly the features of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

1. Introduction

Figure 1:
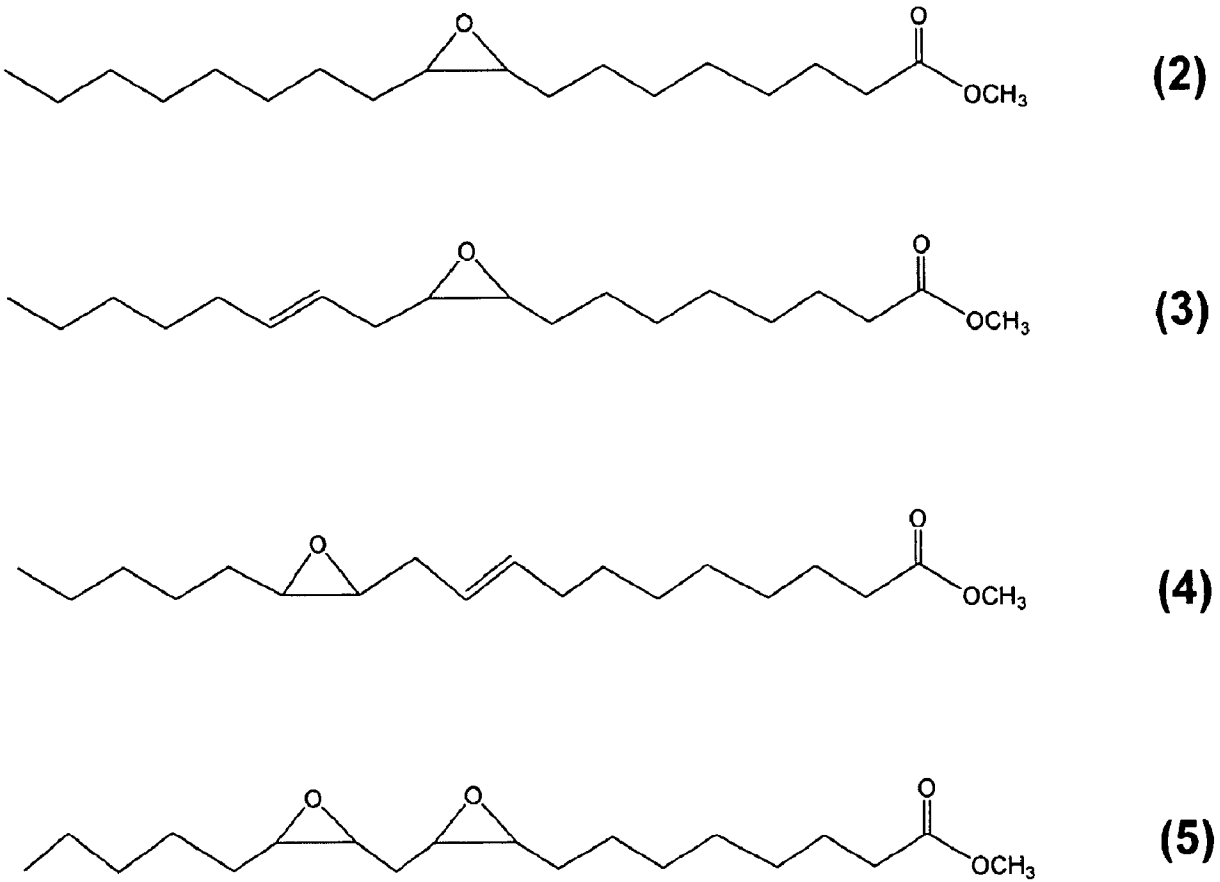
FIG. 1 depicts four exemplary epoxy-ester species (2-5), in accordance with some embodiments of the present invention.

As mentioned above, embodiments of the present invention are generally directed to novel fuel compositions and to methods (i.e., processes) for enhancing the combustion efficiency, and associated ignition properties, of diesel fuels. In some such embodiments, the present invention provides for methods in which to establish a fuel composition comprising (a) a fuel component and (b) an additive component, wherein the resulting fuel composition is imparted with a cetane rating (i.e., number) that is greater than that of the fuel component alone.

The fuel composition embodiments described herein generally comprise (as, or as part of, the additive component) a quantity of one or more epoxy-ester species, wherein the epoxy-ester specie(s) serves to enhance combustion of the fuel composition in which it resides. Method embodiments described herein generally relate to methods of generating such fuel compositions that bear such enhanced combustion properties.

2. Definitions

Certain terms and phrases are defined throughout this description as they are first used, while certain other terms used in this description are defined below:

The prefix "bio," as used herein, refers to an association with a renewable resource of biological origin, such resources generally being exclusive of fossil fuels.

A "biologically-derived oil," as defined herein, refers to any triglyceride-containing oil that is at least partially derived from a biological source such as, but not limited to, crops, vegetables, microalgae, and the like. Such oils may further comprise free fatty acids. The biological source is henceforth referred to as "biomass." For more on the advantages of using microalgae as a source of triglycerides, see R. Baum, "Microalgae are Possible Source of Biodiesel Fuel," Chem. & Eng. News, vol. 72(14), pp. 28-29, 1994.

"Triglyceride," as defined herein, refers to class of molecules having the following molecular structure:

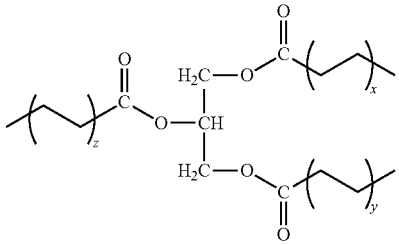

where x, y, and z can be the same or different, and wherein one or more of the branches defined by x, y, and z can have unsaturated regions.

A "carboxylic acid" or "fatty acid," as defined herein, is a class of organic acids having the general formula:

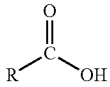

where "R" is generally a saturated (alkyl)hydrocarbon chain or a mono- or polyunsaturated (alkenyl)hydrocarbon chain.

"Lipids," as defined herein, broadly refers to the class of molecules comprising fatty acids, and tri-, di-, and monoglycerides.

"Hydrolysis" of triglycerides yields free fatty acids and glycerol, such fatty acid species also commonly referred to as carboxylic acids (see above).

"Transesterification," or simply "esterification," refers to the reaction between a fatty acid or ester (e.g., a triglyceride) and an alcohol to yield an ester species.

"Transportation fuels," as defined herein, refer to hydrocarbon-based fuels suitable for consumption by vehicles. Such fuels include, but are not limited to, diesel, gasoline, jet fuel and the like.

"Diesel fuel," as defined herein, is a material suitable for use in diesel engines and conforming to the current version at least one of the following specifications: ASTM D 975—"Standard Specification for Diesel Fuel Oils"; European Grade CEN 90; Japanese Fuel Standards JIS K 2204; The United States National Conference on Weights and Measures (NCWM) 1997 guidelines for premium diesel fuel; and The United States Engine Manufacturers Association recommended guideline for premium diesel fuel (FQP-1A).

The term "biodiesel," as used herein, refers to diesel fuel that is at least significantly derived from a biological source, and which is generally consistent with ASTM International Standard Test Method D-6751. Often, biodiesel is blended with conventional petroleum diesel. B20 is a blend of 20 percent biodiesel with 80 percent conventional diesel. B100 denotes pure biodiesel.

"Cetane rating" or "cetane number," as defined herein, is a measure of combustion efficiency of a diesel fuel. Generally, the higher the cetane number, the more easily the fuel self-ignites under compression (as happens in a diesel engine). Additives are often added to increase a diesel fuel's cetane number. Note that pure cetane (hexadecane) has a cetane number (CN) of 100. See, e.g., ASTM International Standard Test Method D-613 for determining cetane number.

"Pour point," as defined herein, represents the lowest temperature at which a fluid will pour or flow. See, e.g., ASTM International Standard Test Methods D 5950-96, D 6892-03, and D 97.

"Cloud point," as defined herein, represents the temperature at which a fluid begins to phase separate due to crystal formation. See, e.g., ASTM Standard Test Methods D 5773-95, D 2500, D 5551, and D 5771.

As used herein, "carbon number" or "Cn," where "n" is an integer, describes a hydrocarbon or hydrocarbon-containing molecule or fragment (e.g., an alkyl or alkenyl group) wherein "n" denotes the number of carbon atoms in the fragment or molecule—irrespective of linearity or branching.

3. Fuel Compositions

As already mentioned, the novel diesel fuel compositions described herein generally comprise a fuel component and an additive component, wherein the additive component comprises a quantity of an epoxy-ester species (vide infra). The epoxy-ester species in the fuel composition provide enhanced combustion efficiency to the diesel fuel in which they reside.

In some embodiments, the present invention is directed to a diesel fuel composition comprising a fuel component and an additive component comprising a quantity of one or more epoxy-ester species having a general formula:

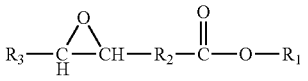

(1)

wherein $R_1$ is selected from the group consisting of C1 to C3 alkyl moieties, $R_3$ is selected from the group consisting of C1 to C10 alkyl moieties and C1 to C10 alkenyl moieties, and $R_2$ is a molecular linkage comprising subunits and expressed as:

$$—S_5—S_4—S_3—S_2—S_1—$$

wherein subunits $S_1$, $S_3$, and $S_5$ are independently selected from the group consisting of C1 to C6 alkyl moieties, C1 to C6 alkenyl moieties, C1 to C6 alkoxy moieties, the absence of any such subunit, and combinations thereof; and wherein subunits $S_2$ and $S_4$ are independently selected from the group consisting of epoxy moieties, C1 to C4 alkyl moieties, C1 to C4 alkenyl moieties, C1 to C4 alkoxy moieties, the absence of any such subunit, and combinations thereof; and wherein said one or more epoxy-ester species account for between 0.1 and 60 percent of the diesel fuel composition by weight.

In some such above-described composition embodiments, at least 80 percent of the epoxy-ester species in the diesel fuel composition have as $R_1$, a methyl moiety. Similarly or alternatively, in some or other such embodiments, at least 50 percent of the epoxy-ester species in the diesel fuel composition have $R_3$ selected from the group consisting of C3 to C9 alkyl moieties. In some or other such embodiments, at least 50 percent of the epoxy-ester species in the diesel fuel composition have $R_3$ is selected from the group consisting of C4 to C8 alkyl moieties. In some or still other embodiments, at least 50 percent of the epoxy-ester species in the diesel fuel composition have as $R_3$ n-octyl.

There can be a considerable amount of variability in the content of epoxy-ester species in the diesel fuel composition. In some such above-described composition embodiments, the one or more epoxy-ester species typically account for between 0.1 and 40 percent of the diesel fuel composition by weight, and at times more typically between 0.5 and 20 percent of the diesel fuel composition by weight.

In some such above-described composition embodiments, said diesel fuel composition has a cetane rating of at least 40, whereas in some or other embodiments, said diesel fuel composition has a cetane rating of at least 45, and in some instances of at least 50.

In some such above-described composition embodiments, the fuel component comprises a biofuel. In some such instances, the fuel component is entirely bio-derived, whereas in other such instances, the fuel component is only partially bio-derived. Advantages to having a biofuel (e.g., biodiesel) component include, but are not limited to, low sulfur content and the renewable nature of the biomass from which such fuels are derived. Such a renewable constituent can render the resulting diesel fuel composition "green."

In some embodiments, the above-described diesel fuel composition has a pour point of less than −5° C., in other embodiments it is less than −7° C., and in still other embodiments it is less than about 9° C. Perhaps correspondingly, in some embodiments, the above-described diesel fuel composition has a cloud point of less than 7° C., in other embodiments it is less than 5° C., and in still other embodiments it is less than 4° C. Those of skill in the art will recognize that environmental, regional, and regulatory factors, as well as the fuels intended use, may provide a need and/or desire for specific pour point and cloud point thresholds/limits.

In some such above-described fuel composition embodiments, the diesel fuel composition has a sulfur content of not more than 300 ppm, in other embodiments not more than 100 ppm, and in still other embodiments not more than 15 ppm. In this regard, the fuel component of a diesel fuel composition can take advantage of the low sulfur content of biofuels when blended with conventional petroleum diesel, or when used exclusively for the fuel component of the fuel composition.

FIG. 1 depicts some exemplary epoxy-ester species (2-5) of the present invention. As these species are epoxidized forms of methyl oleate and methyl linoleate often found in FAME, these species are often complementary to diesel fuel compositions comprising a biodiesel component.

4. Methods

Generally, methods of the present invention are directed toward enhancing the oxidation (combustion) of diesel fuels and correspondingly raising their cetane rating. Additionally, at least in some embodiments, the present invention is additionally directed to methods of making the diesel fuel compositions described in section 3—particularly wherein such compositions have enhanced combustion properties by virtue of epoxy-ester species contained therein.

Figure 2:
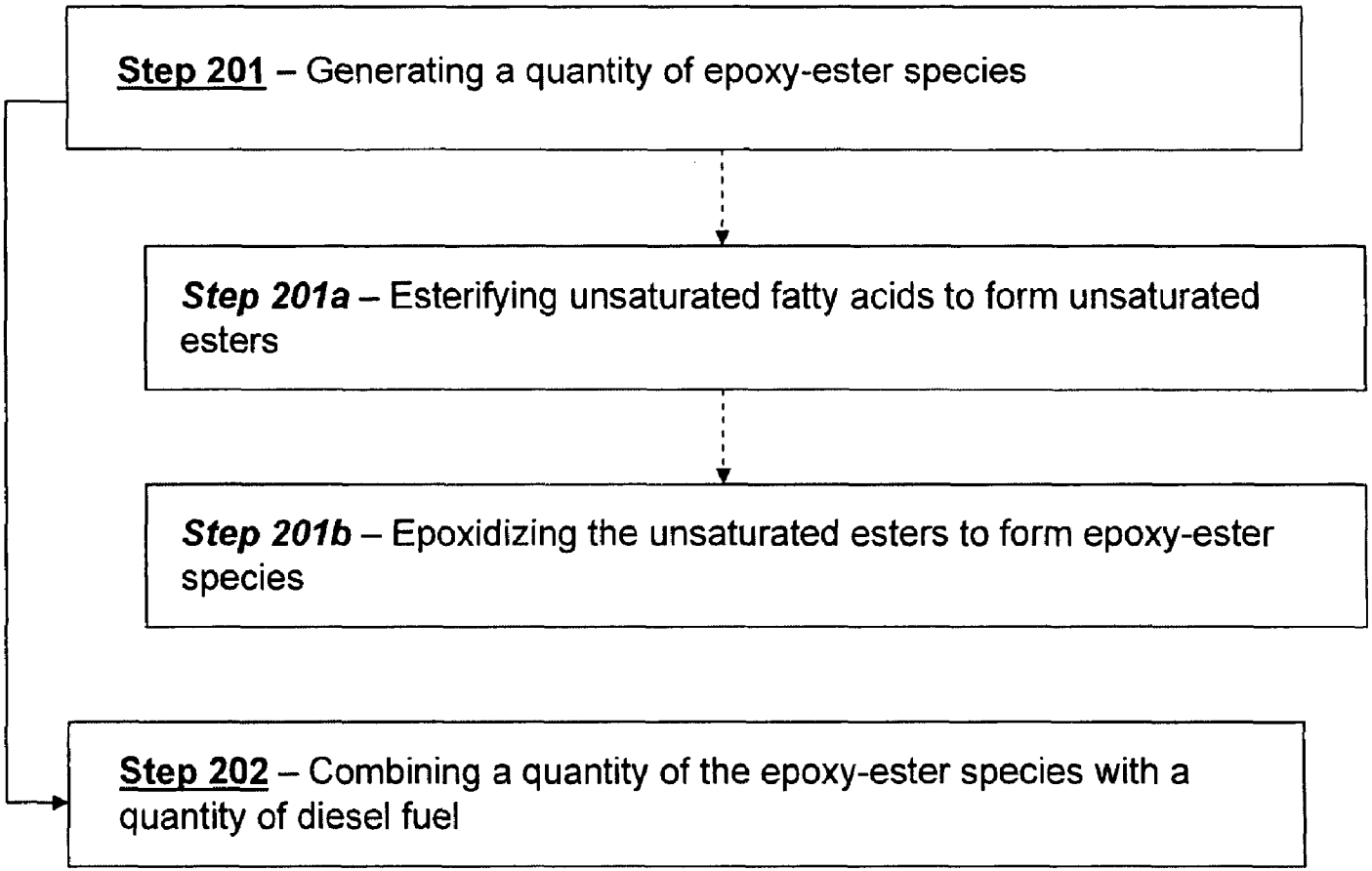
FIG. 2 illustrates, in stepwise fashion, a first type of method for generating a diesel fuel composition of the present invention.

As mentioned previously, and with reference to FIG. 2, in some embodiments the present invention is directed to one or more methods of a first type for improving combustion efficiency, and correspondingly cetane rating, in a diesel fuel, said method(s) comprising the steps of: (Step 201) generating a quantity of epoxy-ester species, said generating comprising the sub-steps of: (Sub-step 201*a*) esterifying a quantity of unsaturated fatty acids having a carbon number of from 8 to 22 with a quantity of alcohol so as to form a quantity of unsaturated esters; and (Sub-step 201*b*) epoxidizing the unsaturated esters to form a quantity of epoxy-ester species; and (Step 202) combining the quantity of epoxy-ester species with a quantity of diesel fuel to provide a diesel fuel composition with increased combustion efficiency.

In some such above-described first types of methods, the diesel fuel comprises at least about 10 wt. % biodiesel, in other embodiments at least about 15 wt. %, and in still other embodiments at least about 20 wt. %. As mentioned in Section 3, the blending of biodiesel with petroleum diesel can have positive and negative effects, and it is in some embodiments an objective of the present invention to optimize the resulting blend for a given application or end use.

In some such above-described first types of methods, the quantity of unsaturated fatty acids comprises at least 10 wt. % oleic acid. Note that oleic acid is commonly derived from vegetable oils (via hydrolysis), as is linoleic acid.

In some such above-described first types of methods, the quantity of alcohol comprises at least 85 wt. % methanol. However, those of skill in the art will recognize that a variety and/or combination of such alcohols (e.g., ethanol, isopropanol, etc.) can also be suitably used.

In some such above-described first types of methods, the sub-step of epoxidizing is carried out in the presence of a peroxide. An exemplary such peroxide is chloroperoxybenzoic acid, but those of skill in the art will recognize that the specific peroxide is not specifically so limited and that one or more of a variety of peroxide species could also be suitably so employed.

In some such above-described first types of methods, the epoxy-ester species account for at least 0.5 wt. % of the diesel fuel composition. In some or other such methods, the epoxy-ester species account for at least 2 wt. % of the diesel fuel composition. In some or still other such methods, the epoxy-ester species account for at least 5 wt. % of the diesel fuel composition. Typically, the amount of epoxy-ester species present in the diesel fuel composition can be correlated with the resulting cetane number, and the amount of such species added or otherwise generated in the fuel composition can be used to produce a desired product cetane number.

In some such above-described first types of methods, the diesel fuel composition has a cetane rating of at least 40. In some or other such methods, the diesel fuel composition has a cetane rating of at least 45. While regulatory factors may require cetane numbers over 50, it is worth noting that cetane numbers greater than 55 often have little additional commercial value or benefit.

Figure 3:
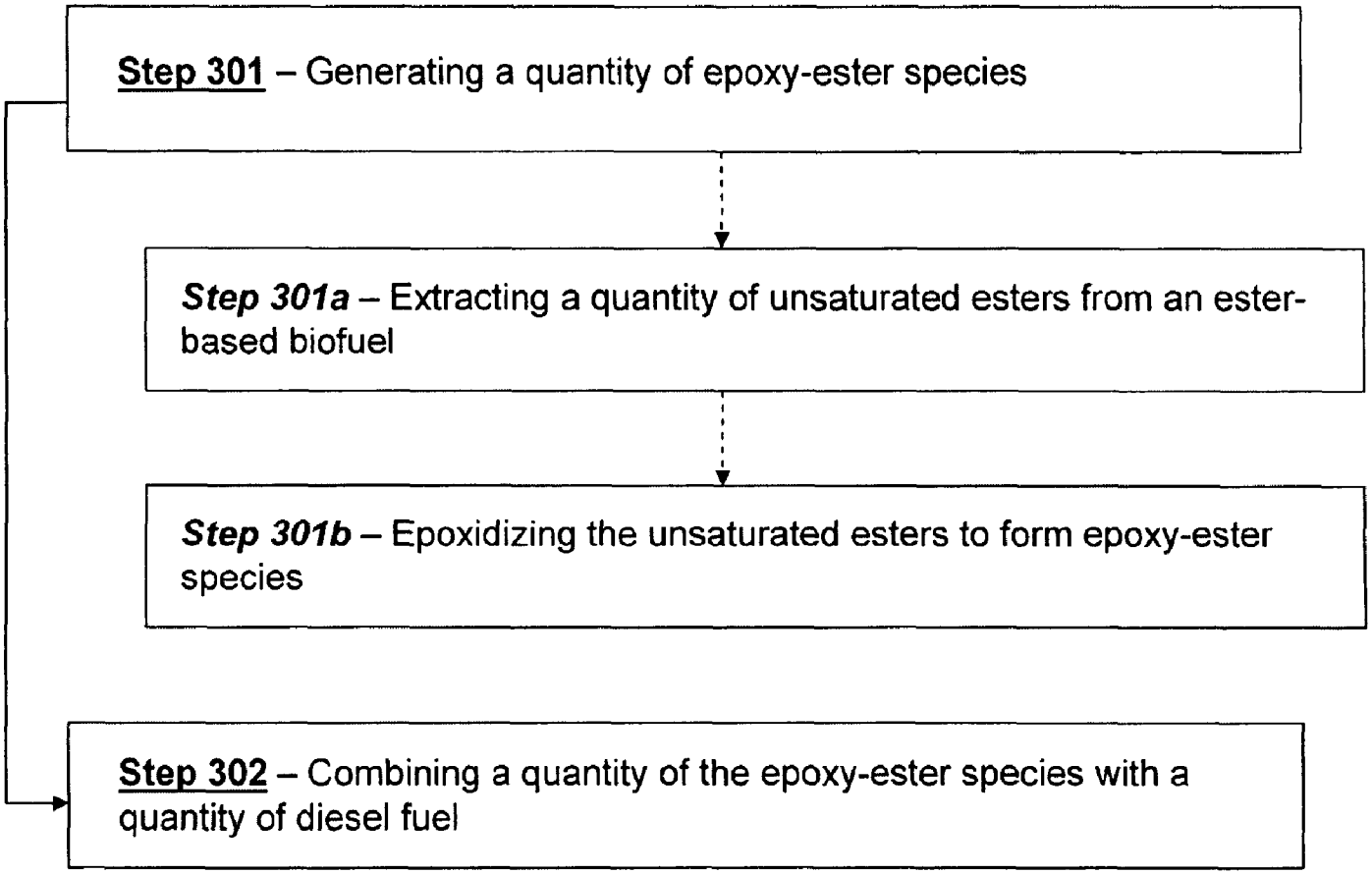
FIG. 3 illustrates, in stepwise fashion, a second type of method for generating a diesel fuel composition of the present invention.

As mentioned previously, and with reference to FIG. 3, in some embodiments the present invention is directed to one or more methods of a second type for improving combustion efficiency, and correspondingly cetane rating, in a diesel fuel, said method(s) comprising the steps of: (Step 301) generating a quantity of epoxy-ester species, said generating comprising the sub-steps of: (Sub-step 301*a*) extracting a quantity of unsaturated esters from an ester-based biodiesel; and (Sub-step 301*b*) epoxidizing the unsaturated esters to form a quantity of epoxy-ester species; and (Step 302) combining the quantity of epoxy-ester species with a quantity of diesel fuel to provide a diesel fuel composition with increased combustion efficiency.

Analogous to the above-described methods of a first type, in some such above-described methods of a second type, the diesel fuel comprises at least about 10 wt. % biodiesel, in some or other embodiments at least about 15 wt. % biodiesel, and in some or still other embodiments at least about 20 wt. % biodiesel.

In some such above-described methods of a second type, the sub-step of epoxidizing is carried out in the presence of a peroxide (or mixture of peroxides). As above, the type of peroxide is not particularly limited, but an exemplary such species is chloroperoxy benzoic acid.

In some such above-described methods of a second type, the epoxy-ester species account for at least 0.5 wt. % of the diesel fuel composition, in some or other embodiments, the epoxy-ester species account for at least 2 wt. % of the diesel fuel composition, in some or still other embodiments, the epoxy-ester species account for at least 5 wt. % of the diesel fuel composition.

In some such above-described methods of a second type, the diesel fuel composition has a cetane rating of at least 40, whereas in some or other such embodiments, the diesel fuel composition has a cetane rating of at least about 45.

Figure 4:
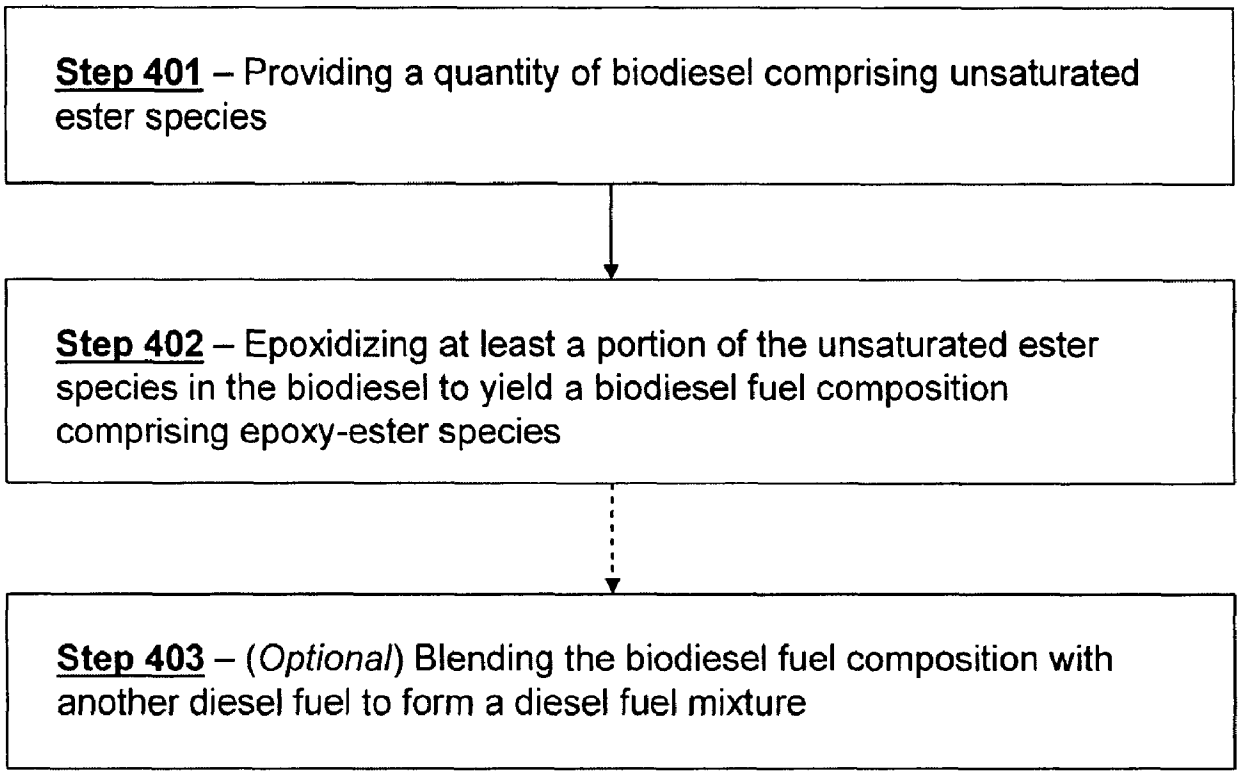
FIG. 4 illustrates, in stepwise fashion, a third type of method for generating a diesel fuel composition of the present invention.

As mentioned previously, and with reference to FIG. 4, in some embodiments the present invention is directed to one or more methods of a third type, such methods comprising the steps of: (Step 401) providing a quantity of biodiesel fuel comprising a quantity of unsaturated ester species; (Step 402) epoxidizing at least a portion of the unsaturated ester species in the biodiesel fuel to form a biodiesel fuel composition comprising a quantity of epoxy-ester species, wherein said biodiesel fuel composition has enhanced combustion efficiency relative to the biodiesel fuel from which it was derived.

In some such above-described methods of a third type, such methods further comprise a (optional) step (Step 403) of blending the biodiesel fuel composition with another diesel fuel to form a diesel fuel mixture having a cetane rating of at least about 40, whereas in some or other such embodiments, the diesel fuel composition has a cetane rating of at least about 45.

In some such above-described methods of a third type, the another diesel fuel comprises biodiesel. Such biodiesel can be of the same or different type (e.g., soy FAME or palm FAME) that the biodiesel from which the epoxy-ester species is derived.

In some such above-described methods of a third type, the unsaturated ester species account for at least 0.05 percent by weight of the quantity of biodiesel fuel, in some other embodiments at least 0.1 percent by weight of the quantity of biodiesel fuel, in some or still other embodiments at least 1 percent by weight of the quantity of biodiesel fuel.

In some such above-described methods of a third type, the step of epoxidizing converts at least 20 percent of the quantity of unsaturated ester species to epoxy-ester species, in some or other embodiments at least 30 percent of the quantity of unsaturated ester species to epoxy-ester species, and in some or still other embodiments at least 40 percent of the quantity of unsaturated ester species to epoxy-ester species.

Figure 5:
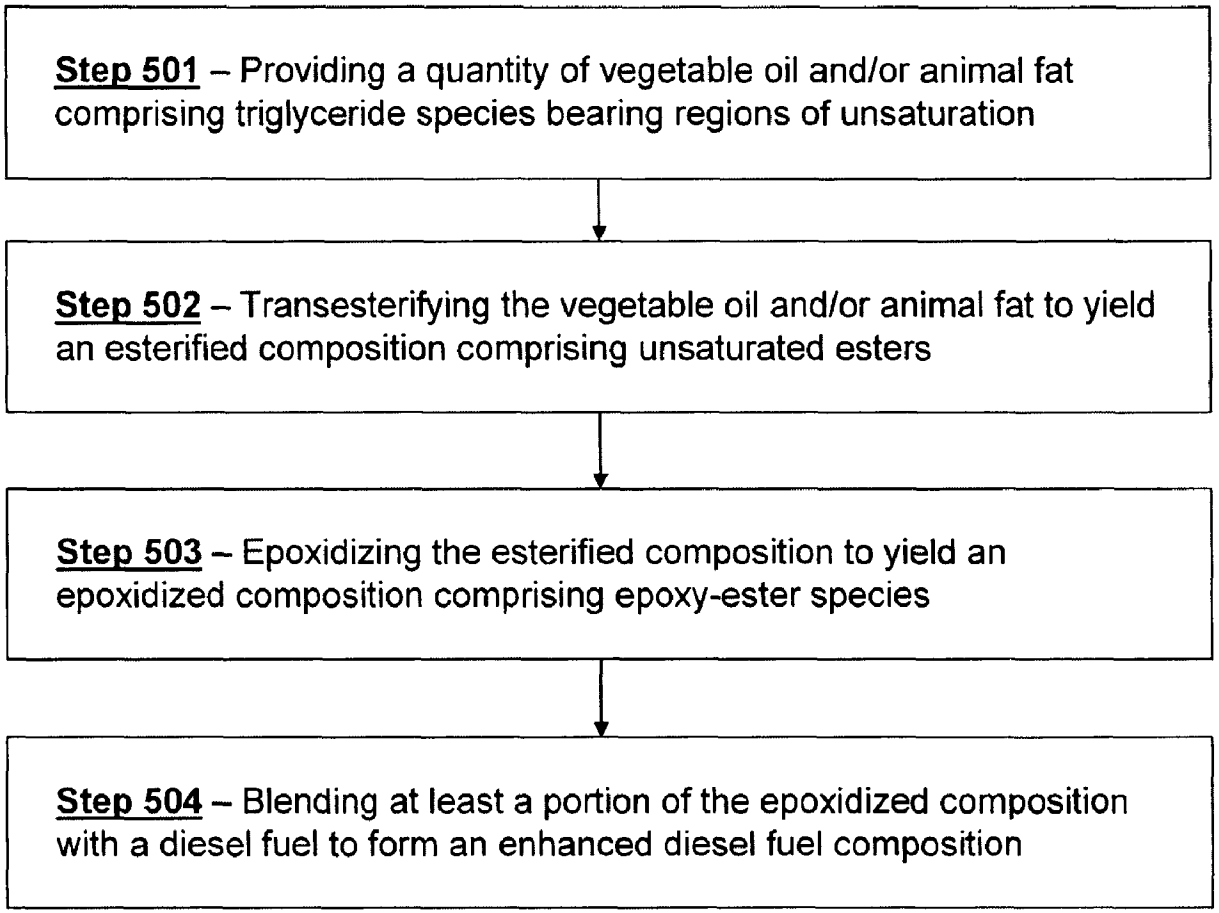
FIG. 5 illustrates, in stepwise fashion, a fourth type of method for generating a diesel fuel composition of the present invention.

With reference to FIG. 5, in some embodiments, the present invention is directed to one or more methods of a fourth type, such methods comprising the steps of: (Step 501) providing a quantity of triglyceride-based oil comprising triglyceride species bearing regions of unsaturation; (Step 502) transesterifying the triglyceride-bearing oil to yield an esterified composition comprising unsaturated esters; (Step 503) epoxidizing the esterified composition to yield an epoxidized composition comprising epoxy-ester species; and (Step 504) blending at least a portion of the epoxidized composition with diesel fuel to form an enhanced diesel fuel composition.

Like the methods described before, in some embodiments, methods of the fourth type are largely directed to the production of diesel fuel compositions such as described above in section 3. Accordingly, precursor materials are generally selected to ultimately provide diesel fuel compositions with enhanced combustion efficiency. In some such embodiments, the diesel fuel to which the epoxidized composition (or portion thereof) is added is, or comprises, biodiesel.

5. Variations

Among other things, biofuels offer the promise of renewable energy, but there are some potential limitations that must be considered—particularly with respect to biodiesel. While advantage can be taken of the renewable nature and low sulfur content of biodiesel when it is blended with conventional petroleum diesel, the resulting blends often suffer from lower pour and cloud points than that of the conventional petroleum diesel from which they are partially derived, this being primarily due to the (typically) poor low-temperature properties of biodiesel.

In some embodiments, the present invention is directed to the methods and compositions that seek to capitalize on the advantages of both biodiesel and petroleum diesel through blending. While the diesel fuel compositions resulting from such blends generally comprise one or more additive components (e.g., an epoxy-ester species), care may also be taken to produce or otherwise derive a diesel fuel composition with particular values for pour point, cloud point, cetane, lubricity, sulfur content, etc., particularly if required for a particular application and/or end use.

While the epoxy-ester species described herein provide enhanced combustion efficiency to the fuel compositions of which they are a part, it is envisioned that such species could be further functionalized with groups that might additionally or alternatively facilitate combustion of a diesel fuel.

6. Examples

The following examples are provided to demonstrate particular embodiments of the present invention. It should be appreciated by those of skill in the art that the methods disclosed in the examples which follow merely represent exemplary embodiments of the present invention. However, those of skill in the art should, in light of the present disclosure, appreciate that many changes can be made in the specific embodiments described and still obtain a like or similar result without departing from the spirit and scope of the present invention.

Example 1

This Example serves to illustrate a method of forming epoxy-ester species from biodiesel, in accordance with some embodiments of the present invention (e.g., methods of the third type).

In this procedure, soy methyl ester (FAME derived from soybean oil) is used as the biodiesel/biofuel comprising unsaturated ester species to be epoxidized. The unsaturated ester species contained therein is oleic acid methyl ester (methyl oleate), $CH_3(CH_2)_7CH{=}CH(CH_2)_7COOCH_3$. This species accounts for approx. 20% of the total palm oil methyl ester composition, while palmitic acid methyl ester, $C_{15}H_{31}COOCH_3$, accounts for approx. 34%. The relative amounts can be determined by gas-chromatography/mass spectrometry (GC/MS) analysis.

Approx. 300 g of homogenized soy methyl ester is weighed and transferred into a flask via a funnel. While stirring, 750 mL of methylene chloride ($CH_2Cl_2$) and 107 g of 3-chloroperoxybenzoic acid (~70-75%) ($ClC_6H_4COOOH$) is added to the flask (over a period of ~20 min.) which is subsequently stoppered. After suitable reaction time, the reaction mixture is filtered and the filtrate collected. Any visible water in the filtrate is removed with anhydrous $MgSO_4$, after which the filtrate is re-filtered.

The above-mentioned filtrate is transferred to a 2000 mL round bottom flask from which the methylene chloride is removed via rotary evaporation. Approx. 750 mL hexanes are added to the residue with heating (~60° C.) until residue is re-dissolved. The resulting solution is then transferred to a separatory funnel where it is washed twice with 750 mL of deionized (DI) water, twice with 700 mL of 10% potassium bicarbonate solution ($KHCO_3$), once (again) with 500 mL of DI water, and finally once with 700 mL of saturated sodium chloride solution (brine) to yield a washed organic phase. The washed organic phase is filtered with a D-glass Büchner frit, and the resulting filtrate is subjected to rotary evaporation to yield a solid or oily product mixture comprising the epoxy-ester species (2) and palmitic methyl ester, wherein the epoxy-ester species has been determined to be present in an amount equal to about 30% of the product mixture, as determined by subsequent GC/MS analysis.

Example 2

This Example serves to illustrate the cetane improvement epoxy-ester species can effect when present in diesel fuel, in accordance with some embodiments of the present invention.

Three samples/blends were prepared: (1) a baseline petroleum diesel sample, (2) 10% soybean FAME in petroleum diesel, and (3) 10% epoxidized soybean FAME in petroleum diesel. These samples/blends were then subjected to an industry standard cetane engine test, i.e., ASTM International Standard Test Method D-613 for determining cetane number. Results from these tests are tabulated below in Table 1. Note that FAME typically has a cetane number of 45-50.

TABLE 1

| Blend/ Sample | Composition | Cetane No. |
|---|---|---|
| 1 | Convention petroleum diesel | 44.6 |
| 2 | 10% soybean FAME + 90% conventional petroleum diesel | 45.3 |
| 3 | 10% epoxidized soybean FAME + 90% conventional petroleum diesel | 49.7 |

7. Conclusion

The foregoing describes embodiments of the present invention that are generally directed to novel fuel compositions and to methods for enhancing the combustion efficiency of diesel fuels, particularly wherein such diesel fuels are (or comprise) biodiesel. Such combustion enhancement is effected by the generation and/or inclusion of epoxy-ester specie(s) in the resulting fuel compositions.

All patents and publications referenced herein are hereby incorporated by reference to an extent not inconsistent herewith. It will be understood that certain of the above-described structures, functions, and operations of the above-described embodiments are not necessary to practice the present invention and are included in the description simply for completeness of an exemplary embodiment or embodiments. In addition, it will be understood that specific structures, functions, and operations set forth in the above-described referenced patents and publications can be practiced in conjunction with the present invention, but they are not essential to its practice. It is therefore to be understood that the invention may be practiced otherwise than as specifically described without actually departing from the spirit and scope of the present invention as defined by the appended claims.

What is claimed:

1. A diesel fuel composition comprising a fuel component and an additive component comprising a quantity of one or more epoxy-ester species having a general formula:

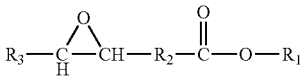

wherein $R_1$ is selected from the group consisting of C1 to C3 alkyl moieties, $R_3$ is selected from the group consisting of C1 to C1O alkyl moieties and C1 to C1O alkenyl moieties, and $R_2$ is a molecular linkage comprising subunits and expressed as:

$$—S_5—S_4—S_3—S_2—S_1—$$

wherein subunits $S_1$, $S_3$, and $S_5$ are independently selected from the group consisting of C1 to C6 alkyl moieties, C1 to C6 alkenyl moieties, C1 to C6 alkoxy moieties, the absence of any such subunit, and combinations thereof; and wherein subunits $S_2$ and $S_4$ are independently selected from the group consisting of epoxy moieties, C1 to C4 alkyl moieties, C1 to C4 alkenyl moieties, C1 to C4 alkoxy moieties, the absence of any such subunit, and combinations thereof; and wherein said one or more epoxy-ester species account for between 0.1 and 60 percent of the diesel fuel composition by weight.

2. The diesel fuel composition of claim 1, wherein at least 80 percent of the epoxy-ester species in the diesel fuel composition have as $R_1$, a methyl moiety.

3. The diesel fuel composition of claim 2, wherein at least 50 percent of the epoxy-ester species in the diesel fuel composition have $R_3$ selected from the group consisting of C3 to C9 alkyl moieties.

4. The diesel fuel composition of claim 2, wherein at least 50 percent of the epoxy-ester species in the diesel fuel composition have $R_3$ is selected from the group consisting of C4 to C8 alkyl moieties.

5. The diesel fuel composition of claim 2, wherein at least 50 percent of the epoxy-ester species in the diesel fuel composition have as $R_3$, n-octyl.

6. The diesel fuel composition of claim 1, wherein said one or more epoxy-ester species account for between 0.1 and 40 percent of the diesel fuel composition by weight.

7. The diesel fuel composition of claim 1, wherein said one or more epoxy-ester species account for between 0.5 and 20 percent of the diesel fuel composition by weight.

8. The diesel fuel composition of claim 1, wherein said diesel fuel composition has a cetane rating of at least 40.

9. The diesel fuel composition of claim 1, wherein said diesel fuel composition has a cetane rating of at least 45.

10. The diesel fuel composition of claim 1, wherein said diesel fuel composition has a cetane rating of at least 50.

11. The diesel fuel composition of claim 1, wherein the fuel component comprises a biofuel.

12. The diesel fuel composition of claim 1, wherein the additive component comprises a quantity of one or more epoxy-ester species selected from the group consisting of (2), (3), (4), and (5)

(2)

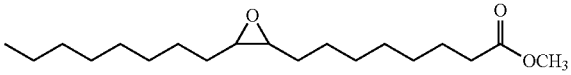

(3)

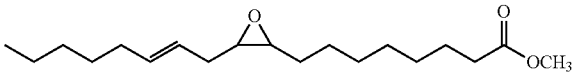

(4)

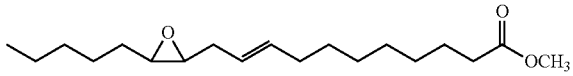

(5)

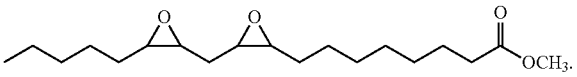

13. The diesel fuel composition of claim 2, wherein the additive component comprises a quantity of one or more epoxy-ester species selected from the group consisting of (2), (3), (4), and (5)

(2)

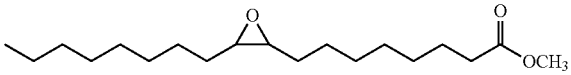

(3)

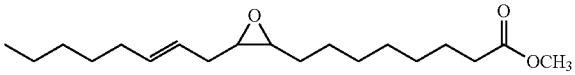

(4)

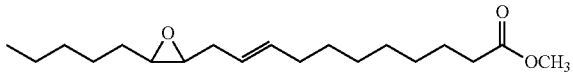

(5)

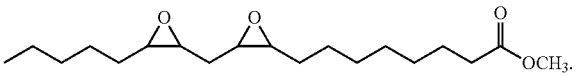

14. The diesel fuel composition of claim 3, wherein the additive component comprises a quantity of one or more epoxy-ester species selected from the group consisting of (2), (3), (4), and (5)

(2)

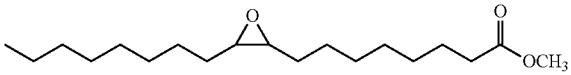

-continued (3)

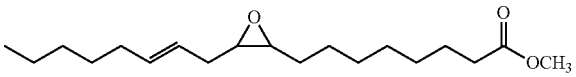

(4)

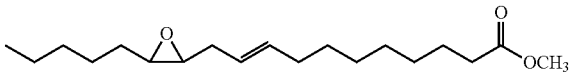

(5)

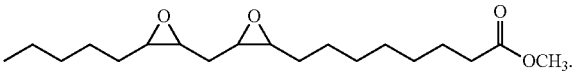

15. The diesel fuel composition of claim 4, wherein the additive component comprises a quantity of one or more epoxy-ester species selected from the group consisting of (2), (3), (4), and (5)

(2)

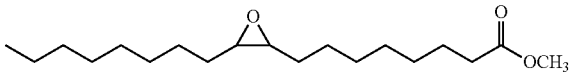

(3)

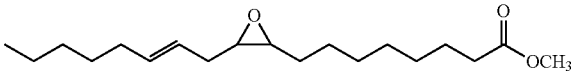

(4)

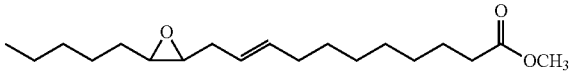

(5)

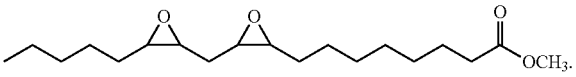

16. The diesel fuel composition of claim 5, wherein the additive component comprises a quantity of one or more epoxy-ester species selected from the group consisting of (2), (3), (4), and (5)

(2)

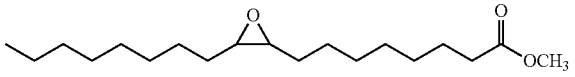

(3)

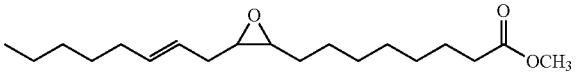

(4)

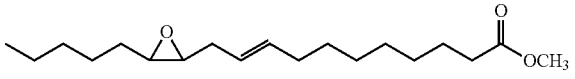

(5)

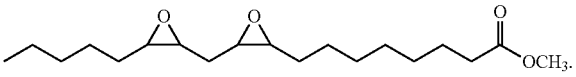

17. The diesel fuel composition of claim 6, wherein the additive component comprises a quantity of one or more epoxy-ester species selected from the group consisting of (2), (3), (4), and (5)

(2)

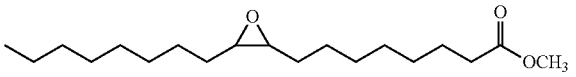

(3)

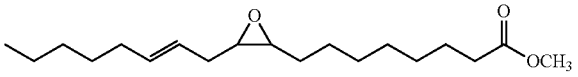

(4)

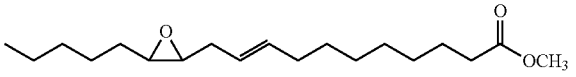

(5)

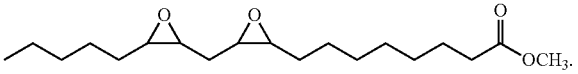

18. The diesel fuel composition of claim 7, wherein the additive component comprises a quantity of one or more epoxy-ester species selected from the group consisting of (2), (3), (4), and (5)

(2)

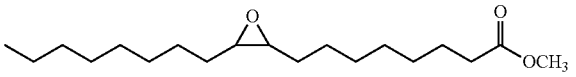

(3)

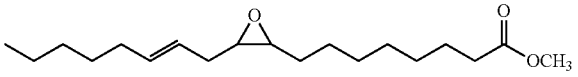

(4)

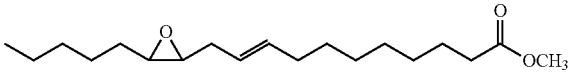

(5)

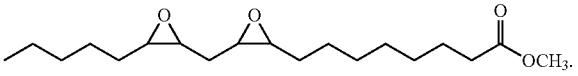

19. The diesel fuel composition of claim 8, wherein the additive component comprises a quantity of one or more epoxy-ester species selected from the group consisting of (2), (3), (4), and (5)

(2)

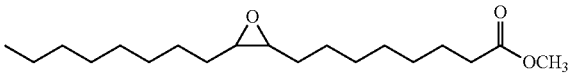

(3)

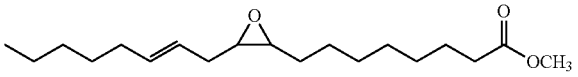

-continued (4)

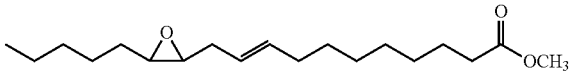

(5)

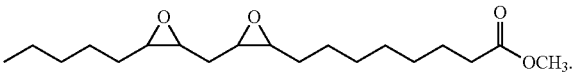

20. The diesel fuel composition of claim 9, wherein the additive component comprises a quantity of one or more epoxy-ester species selected from the group consisting of (2), (3), (4), and (5)

(2)

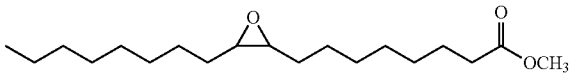

(3)

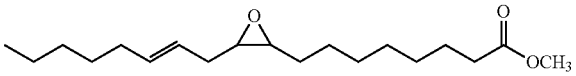

(4)

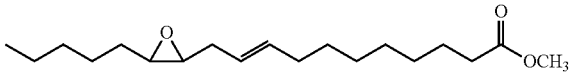

(5)

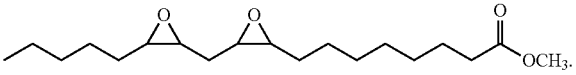

21. The diesel fuel composition of claim 10, wherein the additive component comprises a quantity of one or more epoxy-ester species selected from the group consisting of (2), (3), (4), and (5)

(2)

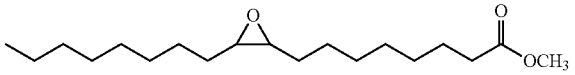

-continued (3)

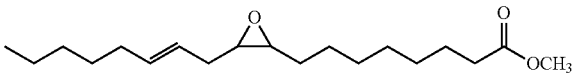

(4)

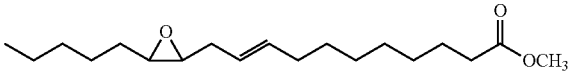

(5)

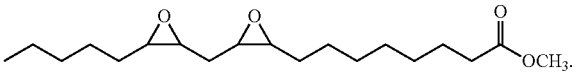

22. The diesel fuel composition of claim 11, wherein the additive component comprises a quantity of one or more epoxy-ester species selected from the group consisting of (2), (3), (4), and (5)

(2)

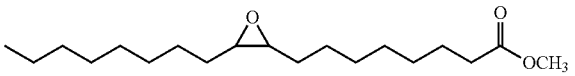

(3)

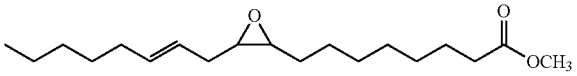

(4)

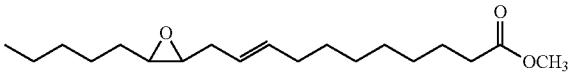

(5)

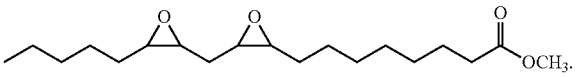

* * * * *